United States Patent [19]

Anetzberger et al.

[11] Patent Number: 4,556,021

[45] Date of Patent: Dec. 3, 1985

[54] DEVICE FOR MANUALLY STARTING AN INTERNAL COMBUSTION ENGINE

[75] Inventors: Max Anetzberger, Hauzenberg; Erich Eder, Vornbach, both of Fed. Rep. of Germany

[73] Assignee: Motorenfabrik Hatz GmbH & Co. KG, Ruhstorf, Fed. Rep. of Germany

[21] Appl. No.: 590,019

[22] Filed: Mar. 15, 1984

[30] Foreign Application Priority Data

Apr. 16, 1983 [DE] Fed. Rep. of Germany ..... 3313891

[51] Int. Cl.[4] ..... F02N 1/02

[52] U.S. Cl. ..... 123/185 S; 74/6

[58] Field of Search ..... 123/185 P, 185 S, 185 C; 74/6

[56] References Cited

U.S. PATENT DOCUMENTS

| | | | |
|---|---|---|---|
| 1,348,931 | 8/1920 | Cook | 123/185 |
| 1,422,972 | 7/1922 | Henry | 123/185 S |
| 1,424,485 | 8/1922 | Kinzie . | |
| 1,503,205 | 7/1924 | Neldner et al. | 123/185 S |
| 1,514,223 | 11/1924 | Neldner et al. | 123/185 S |
| 1,911,113 | 5/1933 | Fry | 123/185 S |
| 3,782,356 | 1/1974 | Hamman | 123/185 S |

FOREIGN PATENT DOCUMENTS

| | | |
|---|---|---|
| 461104 | 5/1928 | Fed. Rep. of Germany . |
| 3129840 | 2/1983 | Fed. Rep. of Germany . |
| 412224 | 7/1910 | France . |
| 513492 | 2/1921 | France . |
| 585934 | 3/1925 | France . |
| 292505 | 11/1928 | United Kingdom . |
| 354732 | 8/1931 | United Kingdom . |
| 378621 | 8/1932 | United Kingdom . |
| 1533953 | 11/1978 | United Kingdom . |
| 1562677 | 3/1980 | United Kingdom . |

*Primary Examiner*—Andrew M. Dolinar

*Attorney, Agent, or Firm*—Flynn, Thiel, Boutell & Tanis

[57] ABSTRACT

A device for manually starting an internal combustion engine includes a rotatably supported shaft, a hand crank, and a safety mechanism operatively coupling the hand crank and shaft and adapted to interrupt the transmission of power therebetween in the event the engine produces a kickback of the shaft. The device includes a closed casing which is filled with a frost-proof lubricant such as lubricating grease, the safety mechanism being provided in the closed casing.

18 Claims, 3 Drawing Figures

DEVICE FOR MANUALLY STARTING AN INTERNAL COMBUSTION ENGINE

FIELD OF THE INVENTION

This invention relates to a device for manually starting an internal combustion engine and, more particularly, to such a device which includes a rotatable shaft, a hand crank, and safety elements arranged between the shaft and the crank and adapted during the starting process to interrupt the transmission of power between the shaft and the crank in the event of a kickback of the shaft or a detachment of the crank.

BACKGROUND OF THE INVENTION

In starting devices of this type, particularly when used for engines of agricultural vehicles, the elements of the device are exposed to very heavy fluctuations of stress which frequently make any kind of smooth functioning impossible. In addition, it has been found that in circumstances of extremely low ambient temperatures, it is not possible to bring the elements of the device into operation with adequate certainty because of the effects of frost. These defects very seriously interfere with the operation of the hand starting mechanism.

SUMMARY OF THE INVENTION

It is an object of the present invention to circumvent these difficulties and to provide a starting device which can be brought into operation with certainty in any ambient conditions. This object is met according to the present invention by providing the safety elements in a closed casing which is filled with a frost-proof lubricant medium, for example lubricating grease.

Since the safety elements of the manual starting device are provided in a housing which is closed and which, prior to the starting operation, can as a whole be moved onto the element of the internal combustion engine which is to be started, a further advantage is that a single manual starting device of the inventive type can be used for starting internal combustion engines of various types.

The provision of the safety elements in a closed casing enables the casing to be tightly sealed against the penetration of dust and/or liquid. Moreover, ready handling of the device is achieved if, in accordance with a further feature of the invention, a resetting member is provided which projects from the casing and which is adapted after any interruption of the transmission of power between the shaft and the crank to reset the safety elements back to their initial condition.

In a preferred form of the invention, the safety elements include a double-armed catch lever having one arm which cooperates with the shaft and having a ratchet spring, and include a ratchet wheel coacting with the spring and connected rigidly to a tubular grip which surrounds the crank and is rotatable relative thereto. The resetting element can be a spring-biased pushbutton.

BRIEF DESCRIPTION OF THE DRAWINGS

An exemplary embodiment will now be described with reference to the accompanying drawings, in which.

DETAILED DESCRIPTION

Figure 1:
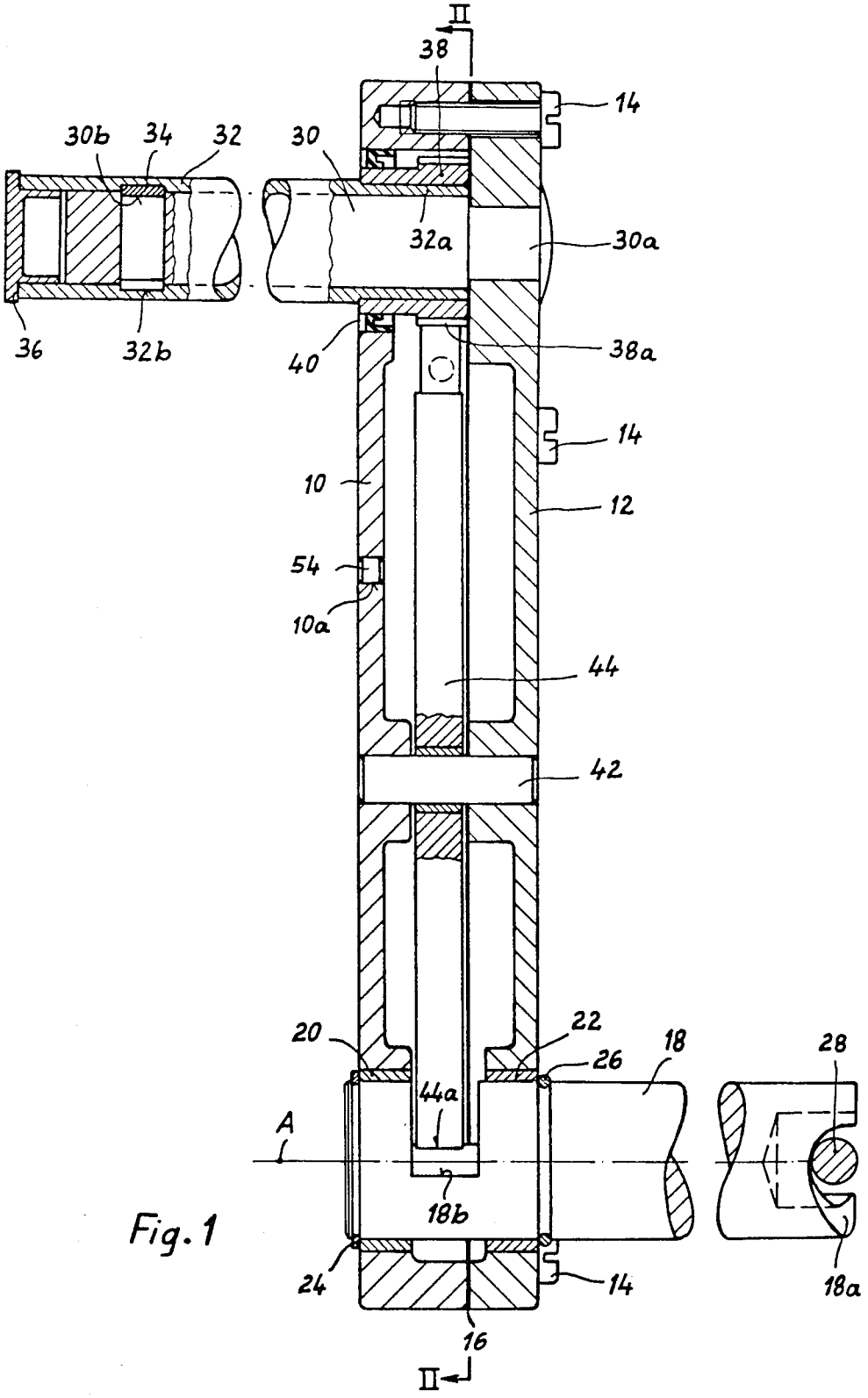
FIG. 1 is a sectional side view of a starting device which embodies the present invention, and shows components thereof in a first position of operation.

The device illustrated in FIG. 1 includes a casing made up of two casing halves 10 and 12 which are secured together by a number of screws 14 with the interpositioning of a flat seal or gasket 16. A shaft 18 is rotatably supported in a sealed fashion at one end of the casings in two cylindrical bearing bushes 20 and 22 which are respectively supported in the casing halves 10 and 12 and are held in proper axial position by means of two spring rings 24, 26. At the outer end of the shaft 18 is a dog 18*a* which can coact with a transverse pin 28 provided on the element (not shown) which is to be turned in order to start a conventional and not illustrated engine. Rigidly secured in the casing half 12, for example by riveting or screwing, is one end 30*a* of a starting pin or crank 30. Supported for free rotation on the crank 30 is a tubular hand grip 32 which is provided externally with axially extending gripping ribs and is preferably made of a plastic material, the axial position thereof relative to the crank 30 being determined by a spring ring 34 which is seated in an outer groove 30*b* provided in the outer surface of the crank 30 and in an internal groove 32*b* provided in the inner surface of the tube 32. A sealing cap 36 is used to close the outer end of the tube 32.

A ratchet wheel or sleeve 38 with external teeth 38*a* about the periphery thereof is freely rotatable in the casing half 10 and is fixedly fastened on, for example by being shrunken onto, the inner end 32*a* of the tube 32. A sealing ring 40 is firmly seated in the casing 10 and sealingly engages the ratchet wheel 38 in order to seal the interior of the casing.

Figure 2:
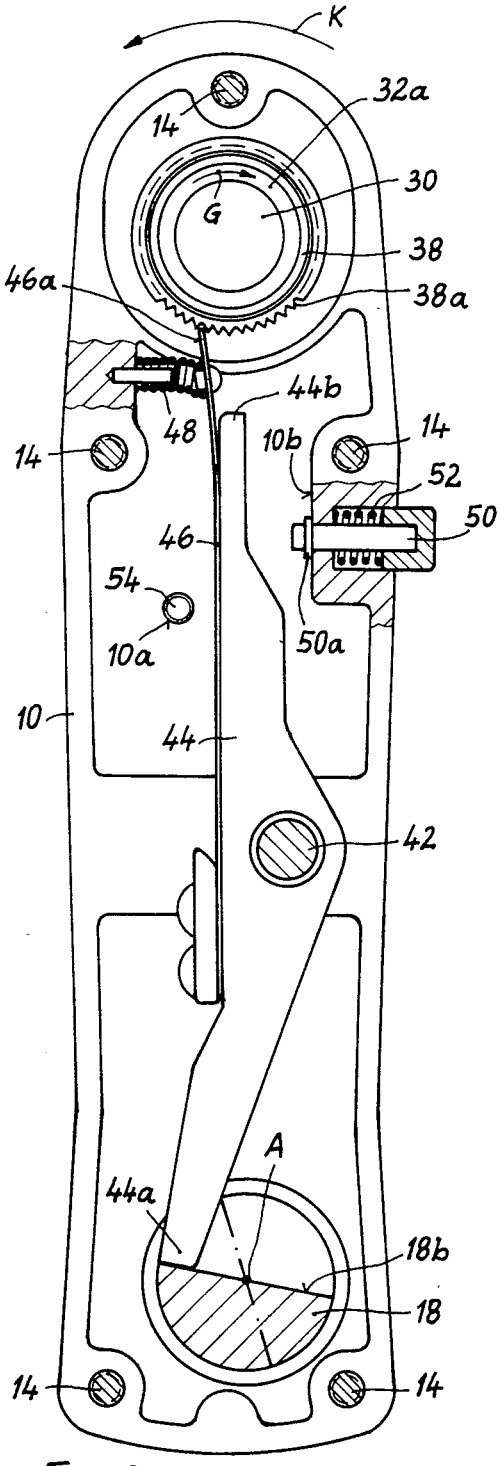
FIG. 2 is a sectional view taken along the line II—II in FIG. 1.
Figure 3:
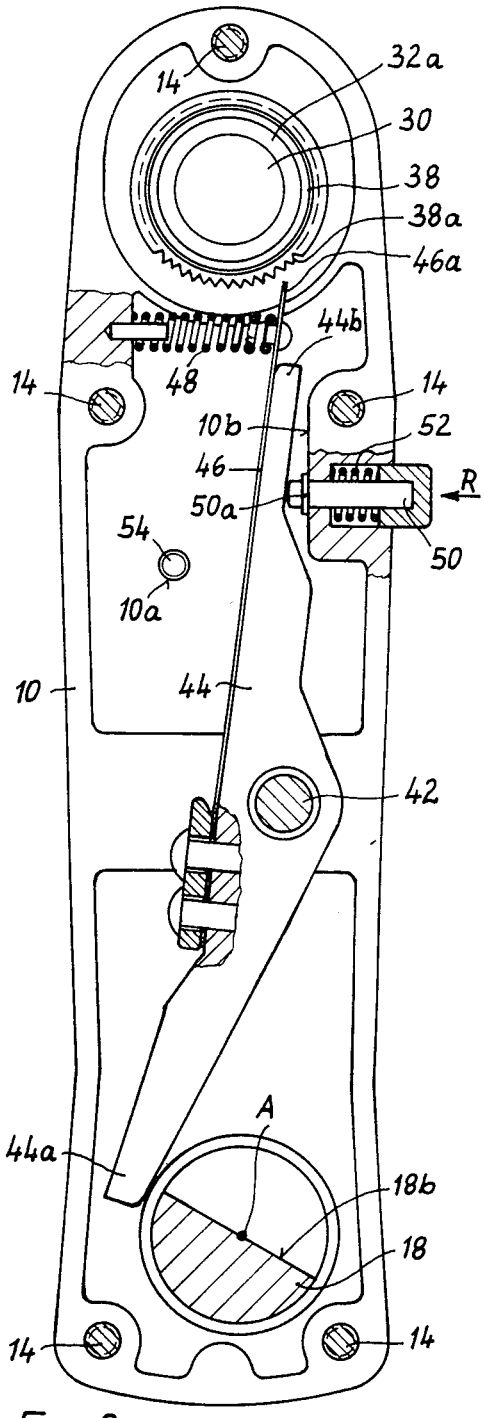
FIG. 3 is a sectional view similar to FIG. 2 but showing a further position of operation.

Pivotally supported in the middle of the casing on a pin 42 is a two-arm lever 44. One arm 44*a* (FIG. 2) of this lever coacts with a flattened surface portion 18*b* on the shaft 18, while a leaf or ratchet spring 46 is secured to the lever 44 so that the end 46*a* thereof projects beyond the other end 44*b* of the lever 44 and cooperates with the teeth 38*a* provided on the ratchet wheel 38. Disposed between an inner surface of the casing half 10 and the end 46*a* of the ratchet spring 46 is a spring 48 which urges the spring 46 and lever 44 to pivot in a clockwise direction in FIG. 2 to a position (FIG. 3) in which the ratchet spring end 46*a* is out of engagement with the ratchet wheel 38 and the lever end 44*a* is spaced radially outwardly from the shaft 18 and the flattened portion 18*b* thereon.

A resetting member in the form of a pushbutton or press pin 50 is movable supported in the casing half 10 and biased by a spring 52. When the pushbutton 50 is manually pressed, it pivots the lever 44 in the counterclockwise direction so that the end 46*a* of the spring 46 re-engages the teeth 38*a* of the wheel 38, and so that the end 44*a* of the lever 44 again makes contact with the flattened portion 18*b* of the shaft 18. The pushbutton 50 is equipped with a circumferential collar 50*a* which coacts with an abutment surface 10*b* on the casing half 10. Through this, the pushbutton 50 in turn functions as an abutment which limits pivotal movement of the lever 44.

During assembly of the casing halves 10 and 12, the interior of the casing is filled with a frost-proofing lubricant, for example grease, to provide a permanent package. A filling opening 10*a* is provided in the casing half 10 to permit the introduction of a frost-inhibiting lubricating liquid, for example greasing oil, into the interior of the device if a liquid lubricant is to be used instead of a consistent greasing medium. The opening 10*a* can be sealed with a screw or pin 54 after the filling with liquid has taken place. To effect the starting, the not-illustrated internal combustion engine is preferably set, in the usual way, to decompression. The shaft 18 of the device is then pushed into the element of the internal combustion engine which is to be turned sufficiently so that the dog 18*a* engages the transverse pin 28 of the element which is to be rotated. Next, the person starting the engine grasps the tubular grip 32 of the crank 30 and turns the complete device in the direction of arrow K around the axis A of the shaft 18. By virtue of the engagement of the end 44*a* of the lever 44 with the surface 18*b* of the shaft 18, the shaft 18 and the element which is to be turned are simultaneously rotated in the same direction. During this rotary movement, a relative movement takes place between the crank 30, which is secured to the casing 10 and the tubular grip 32 which is held by the person starting the engine, and during such relative movement the grip 32 turns in the direction G. The ratchet wheel 38, which is firmly connected to the grip 32, also turns in the direction G relative to the crank 30. The teeth 38*a* of the ratchet wheel 38 successively slide over the end 46*a* of the ratchet spring 46 and produce an audible clicking or ratchet sound. Normally, the engine will start after a few turns of the crank 30 and decompression will automatically be cut off. Since no further resistance can then be detected during movement in the direction K, the person will recognize that the engine is started and will stop turning the device. During stopping there is a small movement of the casing in a direction opposite to the direction K, and the tubular grip 32 and ratchet wheel 38 will perform a small amount of rotational movement in a direction opposite the direction G. Consequently, the teeth 38*a* of the ratchet wheel 38 will carry along the end 46*a* of the ratchet spring 46 to the right in FIG. 2. The lever 44 connected to the ratchet spring 46 will perform a pivoting movement in the clockwise direction around the pivot pin 42, which is aided by the spring 48. At the end of this pivotal movement the arm 44*a* of the lever 44 will be spaced radially outwardly from the oblique surface 18*b* on the shaft 18. This permits the shaft 18 to rotate freely.

With the engine running at speed and the pin 28 thereof coupled to the shaft 18, the shaft 18 is moved by the dog 18*a* axially to the left in FIG. 1 out of engagement with the pin 28. After starting, the elements of the device will be in the operational position illustrated in FIG. 3. Restoration of these elements into the initial position required for power transmission between crank 30 and shaft 18 (see FIG. 2) is produced by pressing pushbutton 50 in the direction R.

If in contrast to the normal starting procedure described above, a sudden kickback movement is imparted by the engine to the shaft 18 in a direction opposite the direction K during starting, for example due to improper firing in the engine, a brief relative movement takes place in a direction opposite direction G between the crank 30 and the grip 32. The ratchet wheel 38 coupled to the tubular grip also participates in this limited rotation opposite to direction G and its teeth 38*a*, aided by spring 48, move the end 46*a* of the ratchet spring 46 out of the position shown in FIG. 2 and into the position shown in FIG. 3. The engagement between the surface 18*b* of shaft 18 and the end 44*a* of lever 44 is thus interrupted, so that the danger of injury to the operator during the kickback, i.e. during a temporary turning back of the shaft 18 in a direction opposite to direction K, is eliminated.

The elements of the device are then restored to their operational positions by pressing the button 50, and the starting process is then repeated until the internal combustion engine starts and is running normally.

It is also to be pointed out that even in the event that the operator releases the tubular grip during the starting procedure, there is no danger of injury. In this case, the tubular grip 32 is left free for rotation in a direction opposite direction G so that the spring 48, which biases the end 46*a* of the ratchet spring 46, will bring the elements 44 and 46 into the inactive position of FIG. 3 and thereby interrupt the power transmission.

The interior of the casing is completely sealed from the exterior thereof by the sealing elements. Consequently, no contamination or particles of dust can reach the safety elements in the casing. This condition is very important, because it guarantees trouble-free engine starting even under severe environmental conditions, for example where the starting device is used in engines of agricultural vehicles or implements. The permanent filling of the interior of the casing with a frost-inhibiting lubricating material also has the advantage of a permanently assuring safe starting of engines even under conditions of extremely low ambient temperatures.

Although a particular preferred embodiment of the invention has been disclosed in detail for illustrativepurposes, it will be recognized that variations or modifications of the disclosed apparatus, including the rearrangement of parts, lie within the scope of the present invention.

The embodiments of the invention in which an exclusive property or privilege is claimed are defined as follows:

1. A device which is separate from and can be temporarily coupled to an internal combustion engine for manually starting the engine, said device comprising a closed casing, a shaft rotatably supported on said casing and having means for releasably coupling said shaft to a movable component of the engine, a hand crank supported on said casing, and safety coupling means for operatively coupling said shaft and said crank in a manner so that, in the event a kickback is imparted to said shaft by the engine during starting and in the event an operator releases said hand crank during starting, the coupling between said hand crank and said shaft is interrupted, wherein said safety coupling means is substantially disposed in said closed casing and wherein said closed casing is filled with a frostproofing lubricant and includes sealing means for preventing said frostproofing lubricant from escaping.

2. The device according to claim 1, wherein said sealing means prevents the entry of dust and liquid into said closed casing.

3. The device according to claim 1, including a resetting member which is movably supported on and projects outwardly from said casing , said safety coupling means being responsive to manual actuation of said resetting member subsequent to an interruption of the coupling between said shaft and said hand crank for reactuating the coupling between said hand crank and said shaft.

4. The device according to claim 1, wherein said safety coupling means includes a pivotally supported, double-armed catch lever having one arm which is engageable with said shaft and having on its other arm a ratchet spring, wherein said hand crank includes a tubular grip which is rotatably supported on said casing, and wherein said safety coupling means includes a ratchet wheel which coacts with said ratchet spring and is connected rigidly to said tubular grip.

5. The device according to claim 3, wherein said safety coupling means includes a pivotally supported catch lever having an arm, and wherein said resetting member is a pushbutton which is biased by a spring and can engage an arm of said catch lever.

6. The device according to claim 1, wherein said shaft and hand crank are supported on said casing for rotation about respective axes which are spaced and substantially parallel to each other.

7. The device according to claim 6, wherein said shaft and said hand crank each have a portion which is disposed within said closed casing, said portion of said hand crank being a toothed ratchet wheel and said portion of said shaft having thereon a surface facing approximately in a direction of rotation of said shaft; and wherein said safety coupling means includes a lever supported within said closed casing for pivotal movement about a pivot axis with respect to said casing between first and second positions, said safety coupling means being actuated and deactuated when said lever is respectively in said first and second positions, said lever having a portion spaced radially from said pivot axis which is engageable with said surface on said shaft in said first position of said lever and which is spaced radially outwardly from said shaft in said second position of said lever, and said lever including means defining a leaf spring having an end which engages the teeth of said ratchet wheel when said lever is in its first position and which is spaced radially from said ratchet wheel when said lever is in its second position.

8. The device according to claim 7, wherein said safety coupling means includes resilient means cooperable with said lever for yieldably urging pivotal movement of said lever in a direction toward said second position thereof, includes a manually operable pushbutton movably supported on said casing and having a portion which is disposed within said closed casing and which, in response to movement of said pushbutton in one direction, engages said lever and pivots said lever toward its first position against the urging of said resilient means, and includes a helical compression spring which has its ends supported on said pushbutton and said casing and which yieldably urges said pushbutton in a direction opposite said one direction.

9. The device according to claim 8, wherein said casing has a pin fixedly secured thereon coaxial with said axis of rotation of said hand crank, and wherein said hand crank includes a tubular grip which is rotatably supported on said pin, said ratchet wheel being provided on said tubular grip at one end thereof.

10. The device according to claim 9, wherein said coupling means on said shaft includes a dog provided at an end of said shaft spaced from said casing.

11. The device according to claim 9, wherein said casing includes two parts which are secured to each other by a plurality of screws, and wherein said sealing means includes a gasket disposed between said parts and effecting a seal therebetween.

12. The device according to claim 9, wherein said leaf spring is a piece of sheet metal fixedly secured to said lever at a location spaced from said end of said leaf spring, and wherein said resilient means includes a helical compression spring having a first end which is supported on said leaf spring near said end thereof and having a second end which is supported on said casing.

13. The device according to claim 12, wherein said frostproofing lubricant is a lubricating grease, and wherein said sealing means includes an annular seal encircling and sealing engaging said tubular grip.

14. A device which is separate from and can be temporarily coupled to an internal combustion engine for manually starting the engine, the engine having a member which is rotated to start the engine, said device comprising a closed casing, a shaft rotatably supported on said casing and having means for releasably coupling said shaft to the member of the engine, a hand crank supported on said casing, and safety coupling means for operatively coupling said shaft and said crank in a manner so that, in the event a kickback is imparted to said shaft by the engine during starting or in the event an operator releases said hand crank during starting, the coupling between said hand crank and said shaft and said engine member is interrupted, wherein said safety coupling means is disposed in said closed casing, wherein said closed casing is filled with a frost-proofing lubricant, wherein said closed casing includes sealing means for preventing said frostproofing lubricant from escaping, and wherein, before commencing starting of the engine, said casing is moved as a whole to a position in which said coupling means on said shaft is coupling said shaft to the engine member which is to be rotated during starting.

15. The device according to claim 14, wherein said sealing means prevents the entry of dust and liquid into said closed casing.

16. The device according to claim 14, including a resetting member which is movably supported on and projects outwardly from said casing, said safety coupling means being responsive to manual actuation of said resetting member subsequent to an interruption of the coupling between said hand crank and said shaft for reactuating the coupling between said hand crank and said shaft.

17. The device according to claim 14, wherein said safety coupling means includes a pivotally supported, double-armed catch lever having one arm which is engageable with said shaft, and having on its other arm a ratchet spring, wherein said hand crank includes a tubular grip which is rotatably supported on said casing, and wherein said safety coupling means includes a ratchet wheel which coacts with said ratchet spring and is connected rigidly to said tubular grip.

18. The device according to claim 16, wherein said safety coupling means includes a pivotally supported catch lever having an arm, and wherein said resetting member is a pushbutton which is biased by a spring and can engage an arm of said catch lever.

* * * * *